United States Patent [19]

Zaltsman

[11] 4,429,799

[45] Feb. 7, 1984

[54] BOTTLE WITH A ONE-PIECE CORKING MEANS

[75] Inventor: Efim Zaltsman, Brooklyn, N.Y.

[73] Assignee: Monarch Wine Co., Inc., Brooklyn, N.Y.

[21] Appl. No.: 384,758

[22] Filed: Jun. 3, 1982

Related U.S. Application Data

[63] Continuation-in-part of Ser. No. 223,894, Jan. 9, 1981, abandoned.

[51] Int. Cl.[3] ..... B65D 1/02; B65D 55/16

[52] U.S. Cl. ..... 215/31; 215/306

[58] Field of Search ..... 215/306, 258, 31; 220/375

[56] References Cited

U.S. PATENT DOCUMENTS

| | | | |
|---|---|---|---|
| 773,345 | 10/1904 | Scheidt . | |
| 1,265,263 | 5/1918 | Sharpe . | |
| 2,814,404 | 11/1957 | Towns . | |
| 2,814,405 | 11/1957 | Edwards . | |
| 2,961,119 | 11/1960 | Leach . | |
| 3,199,707 | 8/1965 | Folkman . | |
| 3,235,117 | 2/1966 | Mason . | |
| 3,407,956 | 10/1968 | Linkletter et al. . | |
| 3,416,688 | 12/1968 | Fanning . | |
| 3,473,685 | 10/1969 | Karlan . | |
| 3,851,783 | 12/1974 | Braginetz | 215/306 X |
| 3,986,627 | 10/1976 | Zapp | 215/306 X |
| 3,990,598 | 11/1976 | Zapp et al. | 215/306 X |
| 3,994,409 | 11/1976 | Nightengale | 215/306 X |
| 4,054,221 | 10/1977 | Glover | 215/306 X |

FOREIGN PATENT DOCUMENTS

| | | |
|---|---|---|
| 2200857 | 7/1973 | Fed. Rep. of Germany . |
| 1580404 | 7/1969 | France . |
| 338108 | 6/1959 | Switzerland . |
| 17886 | of 1899 | United Kingdom . |
| 15267 | of 1901 | United Kingdom . |

*Primary Examiner*—Donald F. Norton

*Attorney, Agent, or Firm*—Kirschstein, Kirschstein, Ottinger & Cobrin

[57] ABSTRACT

A closure arrangement for stoppering bottles with pressurized, carbonated, water-based liquid contents which comprises in combination; a bottle having a body portion, an elongated neck portion with two annular flanges thereon, and a mouth portion; and a one-piece elastomeric plastic molded corking means having an elongated cylindrical stopper insertable into the mouth of the bottle, a head connected to the stopper, an annular, circumferential ring positioned below the head, concentric with the stopper and capable of being received between the two annular flanges, a flexible, elongated folded tether connecting the ring to the head, and a plurality of short frangible bridges connecting the ring to the head, said bridges breaking when the ring is forced between the two flanges. The elongated tether provides a means for preventing injury when the cork is removed from the bottle.

25 Claims, 12 Drawing Figures

FIG. 1
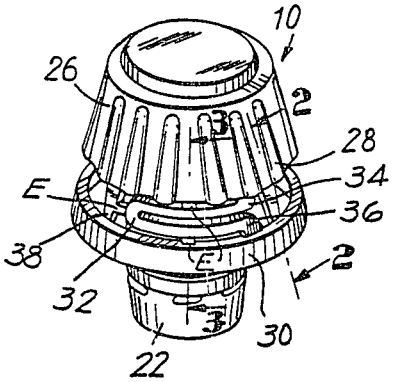
FIG. 2
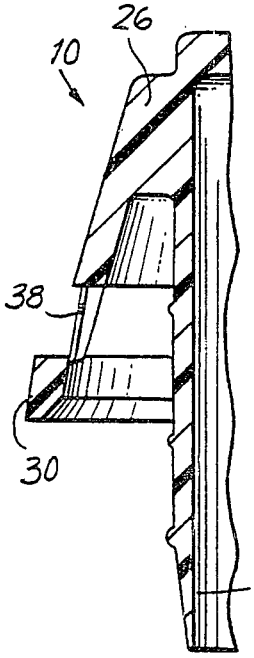
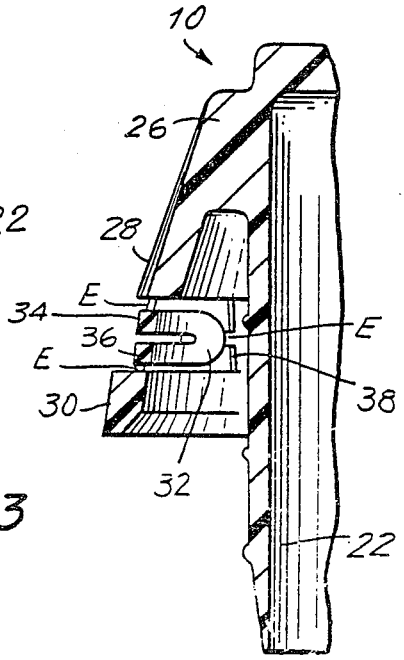
FIG. 3
FIG. 4
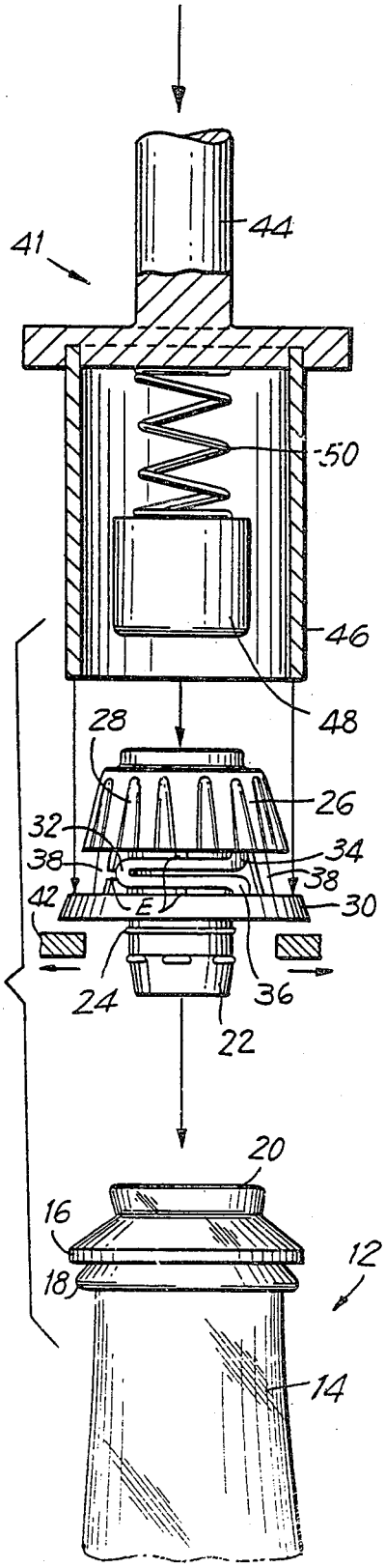

FIG. 1A
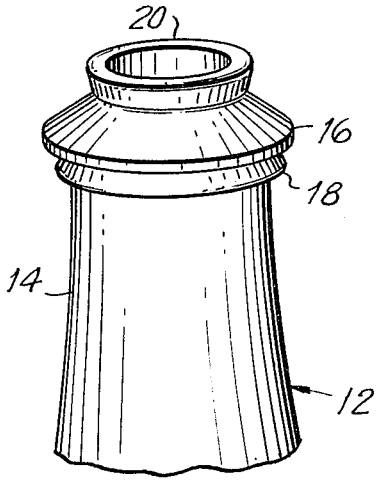
FIG. 10
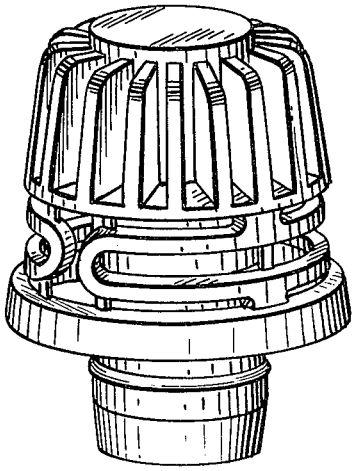
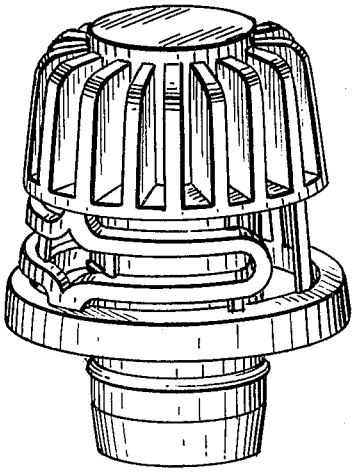
FIG. 11

FIG. 5
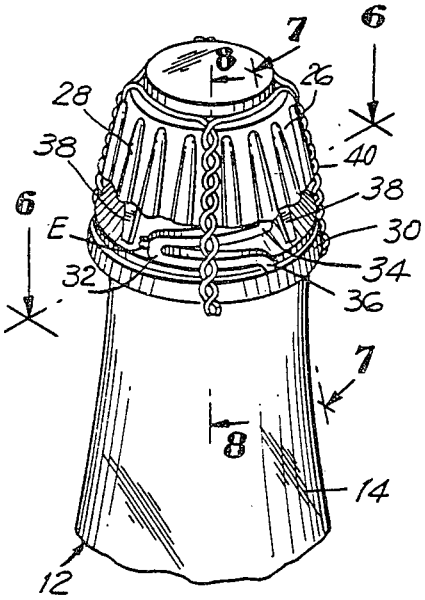
FIG. 6
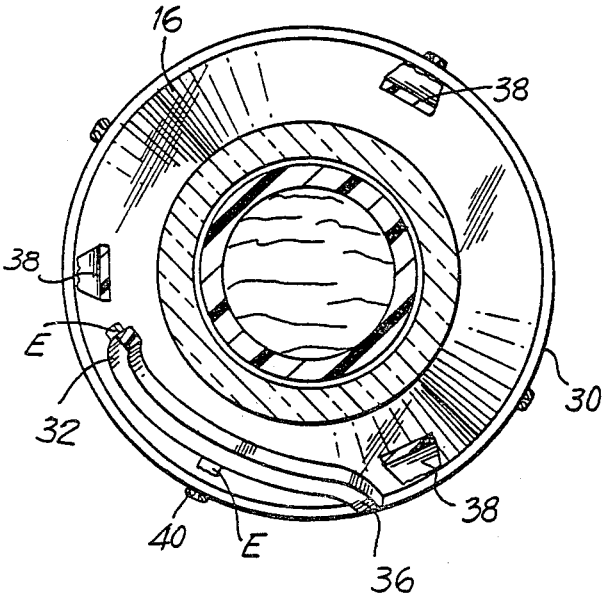
FIG. 7
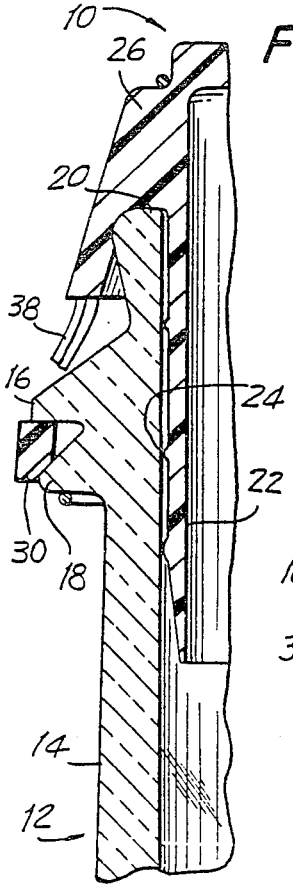
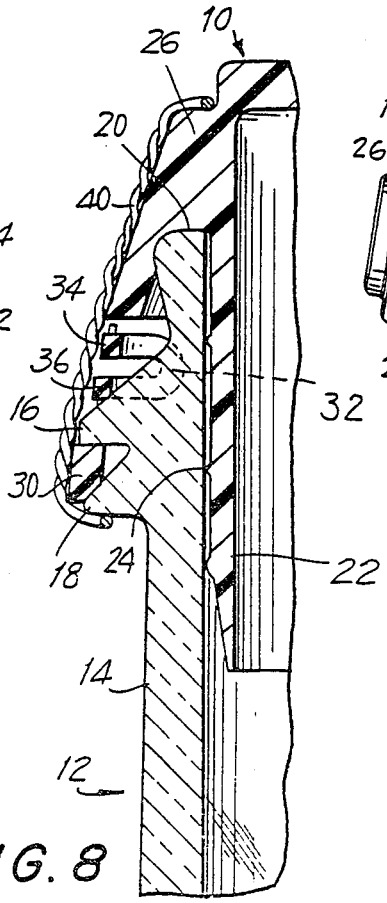
FIG. 8
FIG. 9
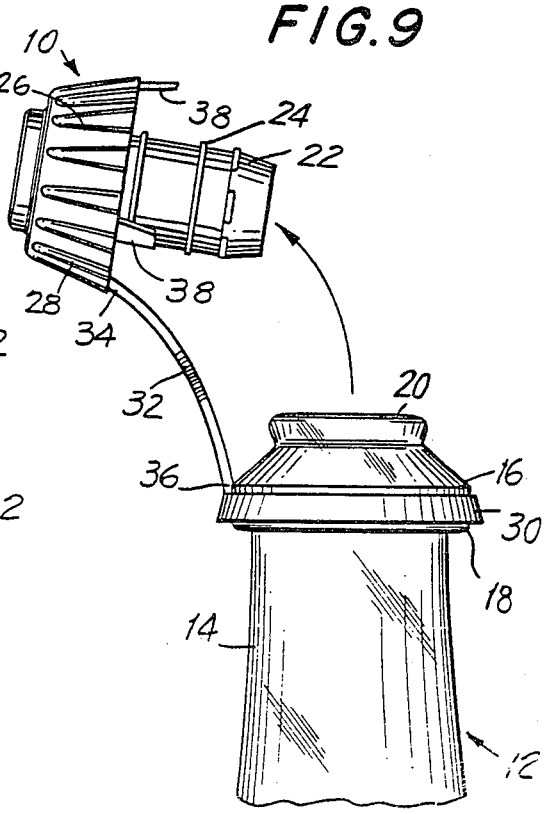

BOTTLE WITH A ONE-PIECE CORKING MEANS

BACKGROUND OF THE INVENTION

CROSS-REFERENCE TO RELATED APPLICATION

This application is a continuation-in-part of copending application Ser. No. 223,894, filed Jan. 9, 1981 for Method And Apparatus For Stoppering Modified Bottles With A One-Piece Corking Means, and now abandoned.

1. Field of the Invention

The present invention generally relates to stoppered and stoppering bottles with pressurized, carbonated, water-based liquid contents and, more particularly, to a plastic one-piece corking means for stoppering bottles with elongated necks having two annular flanges on said neck close to the mouth and to the bottles themselves.

2. Description of the Prior Art

It long has been recognized that bottles with pressurized, carbonated contents present a hazard. When these bottles are opened by a user, oftentimes the cork will be ejected from the bottle with a degree of force capable of causing injury to people. Facial and eye injuries have been known to occur when a cork is propelled out of a bottle with considerable force.

A number of different closure arrangements for bottles with pressurized, carbonated contents have been utilized in the prior art. U.S. Pat. No. 3,986,627 describes a stoppering system for bottles and discloses a cap portion which is attached to a securing ring on the bottle through a flexible bridging member.

The cap portion is not inserted into the neck of the bottle. U.S. Pat. No. 4,054,221 also discloses a capping device in which the cap is attached to a ring on the bottle by a strap portion. This patent, as did the foregoing, discloses a stoppering device that is not inserted into the neck of the bottle. U.S. Pat. No. 773,345 discloses a multi-part stoppering system in which the cork portion is attached to a loop around the bottle neck via a chain or wire.

U.S. Pat. No. 1,265,263 discloses a stoppering system in which a cork portion is secured to a bottle via a rope or wire loop system. This is a multi-part device.

British Pat. No. 15267 discloses a multi-part corking device in which the cork is secured to the bottle via a chain. West German Pat. No. 2,200,857 also discloses a multi-part corking device in which the cork portion is secured to the bottle neck via a tether. Swiss Pat. No. 338,108 discloses a bottle stoppering system in which a cap portion is secured to a bottle via a tether. This stoppering system utilizes a capping, and not a corking device. The tether extends horizontally outward of the outer surface of the bottle. The corking device is of a one-piece plastic construction.

Although all of these closure arrangements appear to be satisfactory for their intended purposes, they have drawbacks for use in stoppering bottles with pressurized, carbonated, water-based liquid contents. Due to the existence of an outwardly extending tether on some of the prior art arrangements, wiring of the bottles after corking is difficult. It is also difficult to pack large numbers of stoppered bottles.

In the prior art arrangements that have multi-part corking portions, problems arise in assembly and inventory which add to the total cost of stoppering the bottles.

SUMMARY OF THE INVENTION

1. Purposes of the Invention

It is an object of the present invention to provide a closure arrangement for stoppering of bottles with pressurized, carbonated, water-based liquid contents which is not subject to the drawbacks of the prior art closures.

It is another object of this invention to provide a safe system for stoppering the afore-described bottles.

It is yet another object of this invention to provide a closure arrangement of the character described which consists of few parts and is easy to assemble.

Still another object of this invention is to provide an inexpensive closure arrangement of the character described.

Yet another object of this invention is to provide a closure arrangement of the character described which allows stoppering of bottles by unskilled laborers.

It is still another object of this invention to provide a method of stoppering bottles with liquid, water-based, pressurized, carbonated contents which is both inexpensive and efficient.

Still another object of this invention is to provide an apparatus for closing bottles whose contents are liquid, water-based, pressurized and carbonated, which allows inexpensive, efficient stoppering of such bottles.

Other objects of the invention in part will be obvious and in part will be pointed out hereinafter.

2. Brief Description of the Invention

In keeping with these objectives, and others which will become apparent hereinafter, one feature of this invention resides, briefly stated, in a closure arrangement for stoppering bottles with pressurized, carbonated, water-based liquid contents which consists of a bottle having an elongated neck portion, a mouth portion, a body portion, two axially spaced annular flanges on the neck portion adjacent to the mouth portion, and a one-piece corking means for stoppering said bottle.

In accordance with another feature of this invention the corking means has an annular ring which is receivable between the annular flanges of the neck portion, a stoppering portion which is receivable within the mouth portion, an elongated flexible tether which is in a fully folded state and lies substantially within the confines of the periphery of the head portion of the corking means prior to the corking of the bottle and which is capable of unfolding slightly as the bottle is corked and further unfolding as the bottle is opened, and a plurality of frangible bridges which connect the stoppering portion to the ring in order to hold the parts of the corking means in proper alignment with one another before assembly on the bottle neck so as to efficiently stopper the bottle.

Another feature of the present invention resides in forming the flexible elongated tether so that it does not extend beyond the external periphery of the annular ring. In this manner, wiring of the bottles, which is standard practice for bottles with pressurized contents, is facilitated as is also the storing of large numbers of stoppered bottles.

A further feature of the invention resides in the connection between the corking means and the bottle provided by the flexible tether in its unfolded condition which prevents possible injury from a cork forcefully propelled out of a bottle.

Still a further feature of this invention resides in an apparatus for stoppering bottles of the character described with a corking means of the character described. The stoppering apparatus has a means for holding the corking means in proper position and orientation above an opened bottle and a driving means for driving the stoppering portion into the mouth portion of the bottle and for concomitantly forcing the annular ring between the two annular flanges.

The tether of the present invention may take on various forms. In one form, only a single tether is utilized. That is to say, a single tether running from the ring to the corking means. In another form, two tethers are employed, the same being on diametrically opposite sides of the ring and on diametrically opposite sides of the corking means. Optionally, more than two tethers may be used, e.g. three, four or more. Also, the tethers can be employed in pairs. That is to say, a pair of tethers can be used jointly to connect the ring to the corking means or, phrased differently, two tethers can be used with their ends adjacent one another at the ring and with their ends adjacent one another at the corking means. This form of construction will be better understood from the detailed description of this form of the invention.

Still another feature of the present invention lies in the bottle configuration constituting two closely spaced flanges below the beaded finish of the neck of which the outer diameter of the upper flange is slightly greater than the outer diameter of the lower flange for reasons which will become apparent as the description proceeds, the difference in diameters being on the order of about one millimeter.

In this manner the bottle can be stoppered in an efficient and inexpensive manner.

The novel features which are considered characteristic of the invention are set forth in the appended claims.

The invention itself, however, both as to its construction and its method of operation, together with additional objects and advantages thereof, will be best understood from the following description of a specific embodiment when read in connection with the accompanying drawings.

BRIEF DESCRIPTION OF THE DRAWINGS

FIG. 1 is a perspective view of the corking means, one of the components of the present invention, said means being shown prior to assembly on the bottle;

FIG. 1A is a perspective view of the top of a bottle in the absence of a corking means;

FIG. 2 is a sectional view taken substantially along the line 2—2 of FIG. 1;

FIG. 3 is a sectional view taken substantially along the line 3—3 of FIG. 1;

FIG. 4 is a partially broken away front view of an apparatus for stoppering bottles in accordance with the present invention;

FIG. 5 is a perspective view of the corking means of the present invention after it is in place on the bottle of the present invention;

FIG. 6 is a sectional view taken substantially along the line 6—6 of FIG. 5;

FIG. 7 is a sectional view taken substantially along the line 7—7 of FIG. 5;

FIG. 8 is a sectional view taken substantially along the line 8—8 of FIG. 5;

FIG. 9 is a front view of the corking means and bottle of the present invention after the bottle has been uncorked;

FIG. 10 is a perspective view of a corking means embodying a modified form of the invention in which a pair of joint tethers connect a single point on a ring to a single point on a corking means; and FIG. 11 is a perspective view of another modified form of the invention, wherein a pair of tethers connect a pair of different points on a ring to a pair of different points on a corking means.

DETAILED DESCRIPTION OF THE PREFERRED EMBODIMENTS

Referring now in detail to the drawings, the reference numeral 10 denotes the corking means of the present invention.

As best seen in FIGS. 4 and 9, the corking means 10 is used to stopper bottles 12 with pressurized, carbonated, water-based liquid contents. The bottles 12 are discussed in detail hereinafter, but generally consist of a body portion (not pictured); an elongated neck portion 14 with two annular flanges 16, 18 thereon; and a beaded mouth portion 20, the flanges being parallel to one another, close to one another and near the mouth portion.

The corking means 10 is a one-piece molded plastic unit constructed of elastomeric material. Preferably, the corking means is constructed of a high density polyethylene, but any other appropriate elastomeric material may be used.

As best seen in FIGS. 1–3, the corking means includes an elongated stopper 22. The stopper 22 is capable of being inserted with frictional engagement into the mouth portion 20 of the bottle 12. The stopper 22 is generally cylindrical. As best seen in FIG. 9, in a preferred embodiment, the stopper portion has on it a plurality, e.g. three, integral concentric annular ribs 24. The ribs 24 increase the amount of friction between the stopper 24 and the mouth portion 20 thereby providing a tighter closure for the bottle 12. They also improve the seal effected by the stopper.

The corking means 10 also has an enlarged head portion 26 which is integral to the stopper 22. The head is provided with evenly spaced longitudinal wedges 28. The wedges 28 provide a user with a better grip on the head portion 26 at the time the corking means 10 is removed from the bottle 12.

The corking means 10 is further provided with an annular circumferential ring 30. The annular circumferential ring 30 is dimensioned and shaped for snug reception between the two annular flanges 16, 18 of the neck portion 14 of the bottle 12. The annular circumferential ring is positioned and spaced below the head portion 26 and is concentric with the stopper 22; it is parallel to the lower surface of the head portion and perpendicular to the longitudinal axis of the stopper.

The corking means 10 has at least one flexible, slender, elongated tether 32. One end 34 of the tether 32 is integrally connected to the bottom of the head portion 26 and the other end 36 of the tether 32 is integrally connected to the top of the annular circumferential ring 30. The tether 32 is in a fully folded state before the corking means 10 is inserted in the bottle 12. Moreover, the folded tether lies substantially within the confines of the periphery of the corking means and is fully folded. This permits the corking means to be handled en masse without entanglement as would be the case if the tether simply constituted a semi-circle extending away from the neck of the bottle ready to become entangled with other like tethers. It also permits the corking means to occupy considerably less space in its non-assembled condition, i.e. before it is assembled on a bottle. The length of the folded tether 32 is substantially greater than the distance between ends 34 and 36. The tether 32 serves to join the head 26 to the ring 30. The reaches of the folded tether are disposed in the space between the head and the ring and are oriented circumferentially of the longitudinal axis of the stopper at a radius approximately equal to that of the ring.

Prior to insertion in the bottle, the corking means includes a plurality of frangible bridges 38 which connect the bottom of the head 26 to the top of the ring 30. The frangible bridges break when the annular ring 30 is forced between the two flanges 16, 18 as best shown in FIGS. 5, 6, 7 and 9.

The bottle 12 whose contents are pressurized and carbonated as mentioned heretofore, has a mouth portion 20, a body portion (not depicted) and a neck portion 14 with two annular flanges 16 and 18 thereon.

The two annular flanges 16 and 18 are relatively axially proximate. Further, flanges 16 and 18 are circumferential and squat. The flanges 16 and 18 are spaced apart longitudinally of the neck portion 14 and lie adjacent to the mouth portion 20.

The bottle 12 may be made of any appropriate material. As the bottle will contain pressurized, carbonated contents, the bottle 12 must be constructed so that it can withstand the pressure of the contents. Further, as the contents of the bottle will usually be champagne, the bottle in a preferred embodiment is made of a colored glass and is shaped and constructed to augment the feelings of celebration and wealth that people usually associate with champagne consumption.

The diameter of the upper annular neck flange 16 is slightly greater than the diameter of the lower annular neck flange 18. Further, the inner diameter of the annular ring 30 is slightly smaller than the outer diameter of the upper annular neck flange 16. In a preferred embodiment, the outer diameter of the upper annular neck flange 16 is about one millimeter more than the outer diameter of the lower annular neck flange 18 and the inner diameter of the annular ring 30 is about 1.5 millimeters less than the outer diameter of the upper annular neck flange 16. The inner diameter of the annular ring 30 is slightly smaller than the outer diameter of the lower annular neck flange 16. In the preferred embodiment as above described, this respective dimensioning of the two annular neck flanges 16 and 18 and the annular ring 30 permits the annular ring 30 to be pushed down mechanically over the upper neck flange, expanding as it does so, and then constrict and come to rest between the two neck flanges 16 and 18 and further permits the annular ring 30 to be reversibly releasable from its position between the two flanges 16 and 18 by manual pressure in a downward direction to expand over the lower neck flange. This is desirable to facilitate pouring of the bottle contents after removal of the stopper from the bottle 12.

The neck portion 14 of the bottle 12 is straight in shape for a few inches and then flares outwardly at a small angle. In a preferred embodiment the neck portion 14 is straight for approximately two to three inches below the mouth and then flares outwardly approximately 2°–3°.

The flexible tether 32 is approximately 1/16 of an inch to a side in square cross-section providing a proper amount of flexibility for said tether to perform all of the functions required of it.

As the corking means 10 is assembled with the bottle 12, various changes occur in some of its component parts.

As best seen in FIGS. 5, 6 and 7, the frangible bridges 38 are broken when the corking means is assembled with the bottle. The frangible bridges will stretch and break when the annular ring 30 is forced down between the two annular flanges 16 and 18 inasmuch as the axial distance between the head and ring of the corking means as molded is less than the distance between these elements as mounted on the bottle. This leaves the flexible tether 32 as the sole connection between the annular ring 30 and the head portion 26.

As the corking means is positioned on the bottle 12, the flexible tether 32 partially unfolds.

Due to the material and dimensions of said flexible tether 32 it is capable of the afore-mentioned partial unfolding during placement of the corking means 10 on the bottle 12.

Additionally, as best seen in FIG. 9, the flexible tether 32 is capable of additional unfolding when the corking means 10 is removed from the bottle 12 prior to pouring of the contents of the bottle. In this manner the flexible tether 32 continuously provides a means for joining together the head portion 26 and the annular ring 30. The flexible tether retains the corking means 10 attached to the bottle 12 when the bottle is open and thus prevents the injuries that might occur when the cork of the bottle with pressurized contents is propelled from such a bottle.

The flexible tether 32 in its unfolded condition is of sufficient length to allow the corking means 10 to be so placed in relationship to the bottle that the corking means 10 does not interfere with the decanting of the bottle contents.

In its folded and also in its partially unfolded condition, the flexible tether 32 extends circumferentially below the head 26 and does not extend beyond the external peripheries of said head 26 and said annular ring 30. This is particularly advantageous in that it prevents interference by the tether 32 with the wire 40 that is wrapped about the bottle 12 after the corking means is positioned therein.

Wrapping of bottles which contain champagne with wire 40 is a standard practice for both safety and aesthetic reasons. It is thus important that the corking means 10 contains no elements which would interfere with the placement of the wire 40 about the closed bottle.

The corking means 10 may, in addition to the parts heretofore described, contain at least one frangible connecting element (E) for connecting the flexible tether 32 to at least one other element of the corking means 10. In a preferred embodiment the corking means has three such frangible connecting elements, connecting the tether 32 to the annular ring 30, the frangible bridges 38 and the head 26. Although all of the parts of the corking means will stay in proper alignment to each other without these frangible connecting elements, the frangible connecting elements provide, if desired, extra stability to the corking means 10 and further provide additional means to keep all other elements of said corking means in proper alignment to one another prior to assembly with the bottle.

A single tether is not always a sufficient precaution against flight of the corking means upon opening of a bottle of champagne or the like. There is a limit to how safe the tether can be made. If a tether is made too thick, it becomes somewhat inflexible and does not stretch out when the cork is pulled so it does not permit a ready pouring of the contents of the bottle. Therefore, some other approach must be used. The approach suggested is the use of more than one tether. For example, as illustrated in FIG. 10, two tethers may be utilized, one on each side of the corking means. Each tether is separately connected to the ring at diametrically opposed points and each tether is separately connected to the head portion of the corking means at diametrically opposed points. Also, three or more tethers can be employed, but todate, these have been found to be impractical to mold. It will be observed, that these multiple tethers just described, are individual, separate tethers, each connected separately at its opposite ends to the ring and to the head portion of the corking means. In lieu thereof, the tethers may constitute tethers which are connected abreast as illustrated in FIG. 11. That is to say, connected in pairs. In this case, two tethers are connected to a single point on the ring and the same two tethers are connected to a single point on the head portion of a corking means. It might be thought that this would result in a lopsided flow of liquid plastic in injection molding, but such is not the case. A corking means thus constructed, has been found to operate satisfactorily. It permits the corking means to fly away from the bottle after initial opening and yet be brought up short without breaking the tethers after it has traveled its restricted limited path.

As can be seen from FIG. 4, the present invention provides both a method of and apparatus for stoppering bottles 12 with pressurized, carbonated, water-based contents.

The bottle provided in the method of this invention, is the bottle 12, heretofore described. The corking means 10 heretofore described, is also provided, as molded, for stoppering the bottle. In accordance with the method of the present invention, the stopper portion 22 of the corking means is inserted into the mouth portion 20 of the bottle 12, and the annular ring 30 is concomitantly forced downwardly until it engages the neck of the bottle between the two annular flanges 16, 18. The wire 40 then is wrapped around the corking means and the bottle. The wire contains a seal (not depicted) to indicate that the bottle has not been opened previously. As is standard in the bottling of champagne and sparkling wines, the corked and wired bottle may be wrapped with a foil-type paper (not depicted).

The wire 40 used for wrapping the corked bottle is a thin soft steel wire which is standard in the art.

An apparatus 41 for stoppering the bottle 12 with the corking means 10 also is provided.

The apparatus includes a locating means 42 for holding the as-molded corking means 10 in proper position and orientation above an open bottle 12 with the stopper directed downwardly directly above the bottle mouth. The locating means may be any appropriate means for so holding the corking means in place. Appropriately, it may include plates capable of moving outwardly away from the center of the corking means 10 to allow the corking means to be positioned in the bottle.

The apparatus 41 further includes a ram 44 for driving the stopper portion 22 into the mouth portion 20 of the bottle 12 and for concomitantly forcing the annular ring 30 between the two annular flanges 16, 18. In a preferred embodiment, there are two auxiliary driving means, namely a sleeve 46 and a plunger 48.

The plunger 48 is attached to the ram by a resilient lost motion means 50 which, in a preferred embodiment, is a compressible spring for yieldingly driving the stopper 22 into the mouth portion 20 of the bottle. The spring is used because after the stopper portion 22 is driven into the mouth 20 by the plunger 48, the sleeve 46 continues to move downwardly, forcing the annular ring 30 between and over the annular flange 16 to come to rest between the flanges 16, 18. The plunger 48 drives the stoppering portion 22 into the mouth portion 20 a split-second before the sleeve 46 forces the annular ring 30 between the flanges 16, 18. The frangible bridges 38 and elements E break as the sleeve forces the annular ring between the annular flanges 16, 18.

The sleeve 46 is dimensioned, shaped and guided to accurately drive the annular ring 30 into position, and the plunger 48 is dimensioned, shaped and guided for accurate driving of the stoppering portion 22 into the mouth portion 20.

As various possible embodiments might be made of the above invention, and as various changes might be made in the embodiment set forth, it is to be understood that all matters herein described and shown in the accompanying drawings are to be interpreted as illustrative and not in a limited sense.

I claim:

1. A closure arrangement for stoppering bottles with pressurized, carbonated, water-based liquid contents, said closure arrangement comprising:

(a) a bottle having: a body portion; an elongated neck portion; and a mouth portion; said neck portion having two relatively axially proximate, circumferential, squat annular flanges spaced apart longitudinally of the neck and adjacent to the mouth; and (b) a corking means of a molded one-piece elastomeric plastic construction having:

(i) an elongated, generally circularly cylindrical stopper, insertable with frictional engagement into the mouth portion of the bottle;

(ii) a head connected to the stopper;

(iii) an annular, circumferential ring, dimensioned and shaped for reception between the two annular flanges of the bottle neck; said annular ring being positioned and spaced below the head as molded and being concentric with the stopper; said ring being located above the flanges prior to its reception there between;

(iv) a flexible, elongated tether having one end connected to the ring and the other end connected to the head for joining said ring to said head, the tether being in a folded state as molded and having a length substantially greater than the distance between said one end and said other end; and (v) a plurality of short frangible bridges circumferentially spaced apart of each other; said frangible bridges connecting the head to the ring; said frangible bridges being broken when the annular ring is forced between the two flanges.

2. A closure arrangement for stoppering bottles with pressurized, carbonated, water-based liquid contents, said closure arrangement comprising in combination:

(a) a bottle having: a body portion, an elongated neck portion; and a mouth portion; said neck portion having two relatively axially proximate, circumferential, squat annular flanges spaced apart longitudinally of the neck and adjacent to the mouth; and (b) a corking means of a molded one-piece elastomeric plastic construction having:

(i) an elongated, generally circularly cylindrical stopper, frictionally engaged in the mouth portion of the bottle;

(ii) a head connected to the stopper;

(iii) an annular circumferential ring, said ring being positioned and spaced below the head and being concentric with the stopper; said ring being located between the two annular flanges of the bottle neck; and (iv) a flexible, elongated tether, having one end connected to the ring and the other end connected to the head; said tether being the sole connection between said head and said ring; the tether being in a partially unfolded condition and capable of additional unfolding in response to manual manipulation of the head to withdraw the stopper from the bottle mouth; said tether having a length substantially greater than the distance between said one end and said other end; said tether in its partially unfolded condition extending circumferentially and not beyond the external peripheries of the head and the ring;

whereby the head may be manually manipulated to remove the stopper from the neck portion of the bottle while the annular ring is captively retained between the two annular flanges of the neck portion of the bottle; said head and said annular ring being interconnected by the tether in its unfolded condition.

3. The stoppering arrangement of claim 1 or claim 2, wherein the outer diameter of the upper annular neck flange is slightly greater than the outer diameter of the lower annular neck flange.

4. The stoppering arrangement of claim 3, wherein the outer diameter of the upper annular neck flange is about one millimeter more than the outer diameter of the lower annular neck flange.

5. The stoppering arrangement of claim 1 or claim 2, wherein the inner diameter of the annular ring is slightly smaller than the outer diameter of the upper neck flange.

6. The stoppering arrangement of claim 5, wherein the inner diameter of the annular ring is about 1.5 millimeters less than the outer diameter of the upper neck flange.

7. The stoppering arrangement of claim 5, wherein the inner diameter of the annular ring is slightly smaller than the outer diameter of the lower neck flange by an amount less than that between said ring and the upper neck flange to allow the annular ring to be reversibly releaseable from its position between the two flanges by manual pressure in a downward direction, thus forcing the ring further downward on the bottle.

8. The stoppering arrangement of claim 7, wherein the inner diameter of the annular ring is about 0.5 millimeters less than the other diameter of the lower neck flange.

9. The stoppering arrangement of claim 7, wherein the neck of the bottle is straight in shape for a few inches and then flares at a small angle.

10. The stoppering arrangement of claim 9, wherein the neck of the bottle is straight in shape for approximately two to three inches and then flares approximately 2°-3°.

11. The stoppering arrangement of claim 1 or claim 2, wherein the flexible tether is rectangular in cross-section and is approximately 1/16 of an inch to a side.

12. The stoppering arrangement of claim 1 or claim 2, wherein the corking means is constructed of a high density polyethylene.

13. The stoppering arrangement of claim 1, wherein the corking means has at least one frangible element connecting a point on the tether to at least one other element of the corking means.

14. The stoppering arrangement of claim 13, wherein the corking means has a plurality of frangible elements connecting spaced points on the tether to a plurality of other elements of the corking means.

15. The stoppering arrangement of claim 14, wherein the corking means has three frangible elements connecting three spaced points on the tether to the annular ring, a frangible bridge, and the head.

16. For use with a bottle having: a body portion; an elongated neck portion; and a mouth portion; said neck portion having two relatively axially proximate, circumferential, squat annular flanges spaced apart longitudinally of the neck and adjacent to the mouth, a cork comprising a corking means of a molded one-piece elastomeric plastic construction, said corking means having:

(a) an elongated, generally circularly cylindrical stopper, insertable with frictional engagement into the mouth portion of the bottle;

(b) a head connected to the stopper;

(c) an annular, circumferential ring, dimensioned and shaped for reception between the two annular flanges of the bottle neck; said annular ring being positioned and spaced below the head as molded and being concentric with the stopper; said ring being located above the flanges prior to its reception therebetween;

(d) a flexible, elongated tether having one end connected to the ring and the other end connected to the head for joining said ring to said head, the tether being in a folded state as molded and having a length substantially greater than the distance between said one end and said other end; and (e) a plurality of short frangible bridges circumferentially spaced apart of each other; said frangible bridges connecting the head to the ring; said frangible bridges being broken when the annular ring is forced between the two flanges.

17. A closure arrangement for stoppering bottles with pressurized, carbonated, water-based liquid contents, said closure arrangement comprising:

(a) a bottle having a mouth, (b) a corking means of a molded one-piece elastomeric construction including (i) an elongated, generally circularly cylindrical stopper, insertable with frictional engagement into the mouth of the bottle, and (ii) a head connected to the stopper, (c) a flexible elongated tether, (d) means for attaching a first portion of the tether to the bottle at a point on the bottle below the mouth, (e) means for attaching a second portion of the tether to the corking means, said second portion being remote from the first portion, (f) the tether including an intermediate portion between the first portion and the second portion, (g) the length of the intermediate portion of the tether between the first and second portions being substantially greater than the distance between the points of attachment of the first and second portions to the bottle and to the corking means, respectively, such length of the intermediate portion being sufficient to permit the corking means to be withdrawn from the mouth of the bottle and to fly away therefrom for a short limited distance, (h) a substantial length of the intermediate portion being in a folded state so as to reduce the effective length of the intermediate portion, said length lying substantially within the confines of the periphery of the head of the stopper, and (j) means to maintain said folded length of the intermediate portion in folded condition.

18. A closure arrangement as set forth in claim 17, wherein means is included to maintain the folded portion close to the bottle.

19. For stoppering a bottle with pressurized, carbonated, water-based liquid contents, which bottle has a neck and includes an annular flange below the mouth of the bottle, a corking means including a stopper having a generally circularly cylindrical portion insertable with frictional engagement into the mouth of the bottle, a flexible, elongated, folded tether lying substantially within the confines of the periphery of the corking means, means for attaching the tether adjacent one end thereof to the stopper, an elastomeric ring, means for attaching the ring to the tether remote from its attachment to the stopper, the ring having an internal diameter slightly less than the external diameter of the flange so that the ring can be forced down over the flange, expanding as it does so and constricting after it has passed the flange whereby to captively retain the ring to the bottle, the bottle having a shape and size below the flange which exceeds the outer diameter of the flange, the tether being long enough to permit the cork to be withdrawn from the mouth of the bottle while the ring is captive on the bottle and to be moved far enough away therefrom to permit pouring of the liquid contents from the bottle.

20. A corking means as set forth in claim 19, wherein there are plural flexible elongated folded tethers lying substantially within the confines of the periphery of the corking means, each being attached adjacent one end thereof to the stopper, and being attached to the ring remote from the tethers' attachment to the stopper, the tethers being long enough to permit the cork to be withdrawn from the mouth of the bottle while the ring is captive on the bottle and to be moved far enough away therefrom to permit pouring of the liquid contents from the bottle.

21. A corking means as set forth in claim 20, wherein there are only two tethers.

22. A corking means as set forth in claim 21, wherein the tethers are disposed on diametrically opposite sides of the corking means.

23. A corking means as set forth in claim 21, wherein the tethers are disposed abreast of each other.

24. For use with a tethered headed cork having a flexible, elongated, folded tether connected adjacent one end to the head of the cork, said tether lying substantially within the confines of the periphery of the head of the cork, an elastomeric ring including means for connection to the tether adjacent its other end, and a bottle adapted to contain pressurized, carbonated, water-based liquid contents, said bottle having a finish at its neck which includes an annular flange the outer diameter of which, is slightly larger than the inner diameter of the ring so that the ring can be pushed down over the flange, expanding as it does so and constricting after it passes the flange whereby to captively retain the ring to the bottle and thereby captively retain the cork to the bottle when the cork is pulled out of the mouth of the bottle and tends to fly away therefrom, the length of the tether between connections being enough to permit the cork to be withdrawn from the bottle while the ring is captive on the bottle, and to be moved away therefrom far enough to permit pouring of the liquid contents from the bottle.

25. A bottle for use with a tethered, headed cork having a flexible, elongated, folded tether connected adjacent one end to the head of the cork, said tether lying substantially within the confines of the periphery of the head of the cork, an elastomeric ring including means for connection to the tether adjacent its other end, said bottle adapted to contain pressurized, carbonated, water-based liquid contents, said bottle having a neck with a finish which includes a pair of annular flanges closely spaced together near the mouth of the bottle, the outer diameter of the flange closest to the mouth, being slightly larger than the inner diameter of the ring so that the ring can be pushed down over this flange expanding as it does so and constricting after it passes such flange and being able to be pushed manually over the next flange, the second flange having a diameter which is large enough to check downward movement of the ring, but small enough to permit the ring to be pushed manually over it.

* * * * *